US007442869B2

(12) United States Patent
Zinato

(10) Patent No.: US 7,442,869 B2
(45) Date of Patent: Oct. 28, 2008

(54) METHOD AND ELECTRONIC DEVICE USED TO SYNTHESISE THE SOUND OF CHURCH ORGAN FLUE PIPES BY TAKING ADVANTAGE OF THE PHYSICAL MODELING TECHNIQUE OF ACOUSTIC INSTRUMENTS

(75) Inventor: Carlo Zinato, Polverigi (IT)

(73) Assignee: Viscount International S.p.A., Mondaino (RN) (IT)

( * ) Notice: Subject to any disclaimer, the term of this patent is extended or adjusted under 35 U.S.C. 154(b) by 0 days.

(21) Appl. No.: 10/549,388

(22) PCT Filed: Mar. 25, 2004

(86) PCT No.: PCT/IT2004/000153

§ 371 (c)(1),
(2), (4) Date: Sep. 15, 2005

(87) PCT Pub. No.: WO2004/086353

PCT Pub. Date: Oct. 7, 2004

(65) Prior Publication Data

US 2006/0201312 A1 Sep. 14, 2006

(30) Foreign Application Priority Data

Mar. 28, 2003 (IT) ..... MC2003A0032

(51) Int. Cl.

| | |
|---|---|
| ***G10H 1/08*** | (2006.01) |
| ***G10H 1/12*** | (2006.01) |
| ***G10H 1/16*** | (2006.01) |
| ***G10H 1/24*** | (2006.01) |
| ***G10H 5/02*** | (2006.01) |

(52) U.S. Cl. ..... 84/620; 84/686; 84/659; 84/622

(58) Field of Classification Search ..... 84/659, 84/620, 686, 622
See application file for complete search history.

(56) References Cited

U.S. PATENT DOCUMENTS

| | | | | | |
|---|---|---|---|---|---|
| 3,515,792 | A | * | 6/1970 | Deutsch | 84/605 |
| 3,722,344 | A | * | 3/1973 | Nakada | 84/648 |
| 3,809,789 | A | * | 5/1974 | Deutsch | 84/608 |
| 3,816,635 | A | * | 6/1974 | Uetrecht | 84/675 |
| 3,867,862 | A | * | 2/1975 | Jones et al. | 84/698 |
| 3,884,108 | A | * | 5/1975 | Deutsch | 84/631 |
| 3,910,150 | A | * | 10/1975 | Deutsch et al. | 84/608 |
| 3,972,259 | A | * | 8/1976 | Deutsch | 84/626 |
| 4,082,028 | A | * | 4/1978 | Deutsch | 84/623 |
| 4,348,931 | A | * | 9/1982 | Wade | 84/632 |
| 4,423,655 | A | * | 1/1984 | Turner | 84/620 |
| 4,984,276 | A | * | 1/1991 | Smith | 381/63 |
| 5,157,216 | A | * | 10/1992 | Chafe | 84/695 |
| 5,272,275 | A | * | 12/1993 | Kunimoto | 84/661 |
| 5,408,042 | A | * | 4/1995 | Masuda | 84/661 |

(Continued)

*Primary Examiner*—Lincoln Donovan
*Assistant Examiner*—Andrew R Millikin
(74) *Attorney, Agent, or Firm*—Hodes, Pessin & Katz, P.A.

(57) ABSTRACT

The present invention consists in a method and electronic device used to reproduce the sound of church organ flue pipes, by taking advantage of the physical modeling technique of acoustic instruments; it being an audio-digital synthesis system based on digital signal processors, which contains a program of physical simulation of the generation of the sound of organ flue pipes.

11 Claims, 8 Drawing Sheets

U.S. PATENT DOCUMENTS 5,442,128 A * 8/1995 Bodini et al. ..... 84/620
5,451,711 A * 9/1995 Kunimoto ..... 84/625
5,500,486 A * 3/1996 Smith, III ..... 84/622
5,508,473 A * 4/1996 Chafe ..... 84/659
5,521,328 A * 5/1996 Kakishita ..... 84/661
5,587,548 A * 12/1996 Smith, III ..... 84/659
5,741,994 A * 4/1998 Takeuchi ..... 84/660
5,744,741 A * 4/1998 Nakajima et al. ..... 84/622
5,917,917 A * 6/1999 Jenkins et al. ..... 381/63
2005/0120870 A1 * 6/2005 Ludwig ..... 84/661

* cited by examiner

METHOD AND ELECTRONIC DEVICE USED TO SYNTHESISE THE SOUND OF CHURCH ORGAN FLUE PIPES BY TAKING ADVANTAGE OF THE PHYSICAL MODELING TECHNIQUE OF ACOUSTIC INSTRUMENTS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

Field of the Invention

The present patent application refers to a method and electronic device used to synthesise the sound of church organ flue pipes, by taking advantage of the physical modeling technique of acoustic instruments.

Numerous numerical algorithms of physical-mathematical models have been developed based on the examination of the physical behaviour of organ flue pipes and the sound they produce, in order to synthesise the sound emission of aerophone instruments in real time. These models are based on the mutual symbiotic interaction between a non-linear active section, generally defined as "excitation", and a linear passive section, generally defined as "resonator". The relative numerical algorithm extemporarily produces a sequence that represents the sound of the instrument analysed and translated into a physical model. The sound is characterised by an initial time interval, defined as "attack transient", during which intensity increases up to a certain value. The intensity value is indefinitely maintained over time during the second phase, defined as "sustain phase", during which the waveform is approximately periodic. The analytical characteristics of this waveform, of which the most important is fundamental frequency, depend on each of the parameters that regulate the operation of the numerical simulation.

Being the simulation performed in the time domain instead of the frequency domain because of the presence of numerous non-linear functional blocks, the relation between the set of parameters and each spectral characteristic of the generated sequence is extremely difficult to establish a priori. The characteristics can be altered by changing the set of parameters, often empirically, and then evaluating the effect of such a change a posteriori. In particular, the fundamental frequency also depends on the quantitative characteristics of excitation, and not only on the frequency response of the resonator; being the evolution of the sequence extremely chaotic during the attack transient phase, the phase of the fundamental frequency cannot be pre-determined once the sustain phase has been reached. These two peculiarities are unacceptable in high-polyphony electronic musical instruments, such as church organs.

BRIEF SUMMARY OF THE INVENTION

The present invention consists in an audio-digital synthesis system based on digital signal processors, which contains a programme of physical simulation of the sound generation of organ flue pipes. The programme is divided into three fundamental, conceptually independent sections: the first section generates the harmonic part of the sound; the second section generates the aleatory part of the sound; the third section processes these components by means of a transfer function with two inputs and one output, thus obtaining the sequence that represents the sound of the organ pipe. Because of the independence of the section that generates the harmonic part of the sound, the fundamental frequency and the phase of the whole waveform generated by the programme can be determined a priori.

The numerical parameters of the simulation programme are partially contained in a static memory and partially obtained by processing information from an electronic musical keyboard and from a set of user controls in real time. They determine the fundamental characteristics of the generated sound, among which the main characteristics are pitch, intensity, time envelope, harmonic composition and aleatory component.

BRIEF DESCRIPTION OF THE SEVERAL VIEWS OF THE DRAWING(S)

For major clarity the description of the method and device according to the present invention continues with reference to the enclosed drawings, which are intended for purposes of illustration only and not in a limiting sense, whereby:

Figure 12:
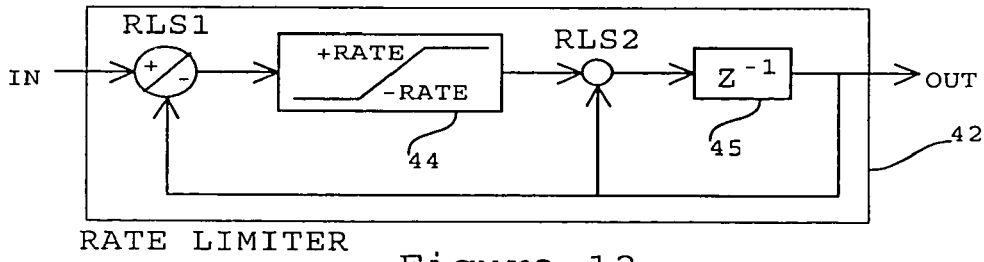
FIG. 12 shows a status device used to limit the difference between two consecutive samples of a sequence according to the invention.
Figure 19:
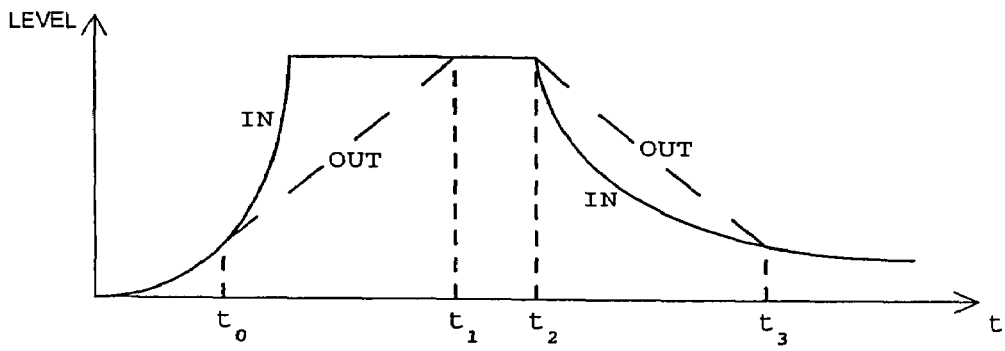

FIG. 19 explains the operation of the status machine of FIG. 12 according to the invention.

DETAILED DESCRIPTION OF THE INVENTION

Figure 1:
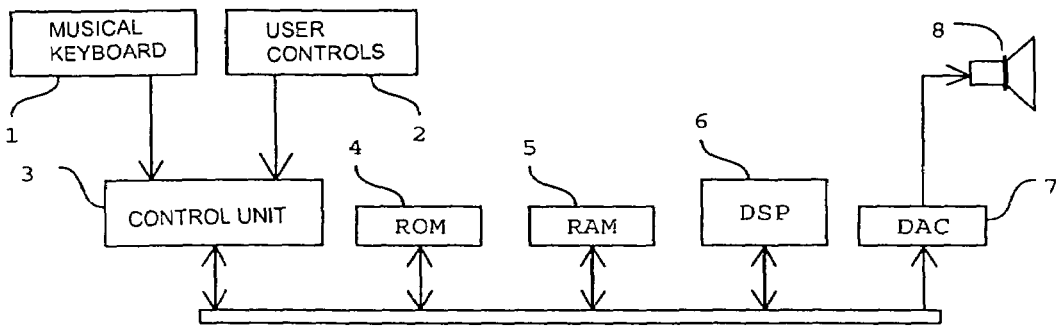
FIG. 1 shows a realisation of a digital electronic musical instrument used to synthesise sounds of musical instruments by taking advantage of the physical modeling technique of the invention.

With reference to the aforementioned figures, the electronic musical instrument of the invention is physically composed of a set of components, whose type, arrangement and interconnection are shown in FIG. 1.

Figure 2:
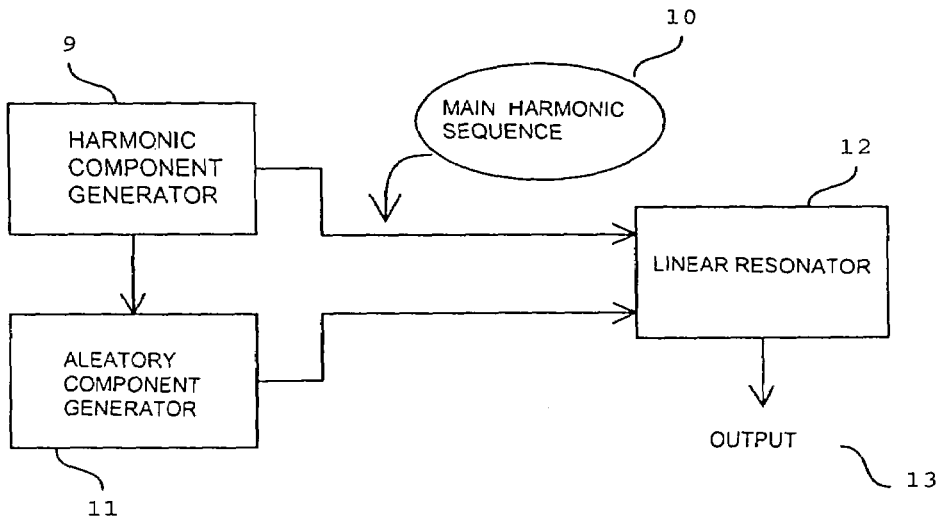
FIG. 2 shows the three fundamental functional blocks and relative interconnections of an audio digital synthesis programme of the sounds of church organ flue pipes according to the invention.

The embodiment is shown for mere illustrative purposes, since it neither represents the central innovation element of the present patent nor the only and necessary realisation of an electronic musical instrument used to synthesise the sound the organ pipes by means of algorithms of physical-mathematical simulation. With reference to FIG. 1, the information from a musical keyboard (1) and a set of user controls (2) is processed by a control unit (3), which regulates the operation of a DSP (6) by means of a plurality of numerical parameters contained in a ROM (4). The DSP (6) executes the synthesis programme of the sound of the organ pipe in real time, upon management from the control unit (3), using a RAM (5) to write and read temporary data. The product of the synthesis programme is a numerical sequence that is suitably converted by a DAC (7) into the analogue signal representing the sound of the organ pipe, which can be reproduced with an amplification system and a loudspeaker (8). The synthesis programme, which is the central innovation element of the present patent, includes three sections. Each section has a fundamental function in the numerical simulation of the sound emission of the organ pipe, as shown in FIG. 2.

Figure 3:
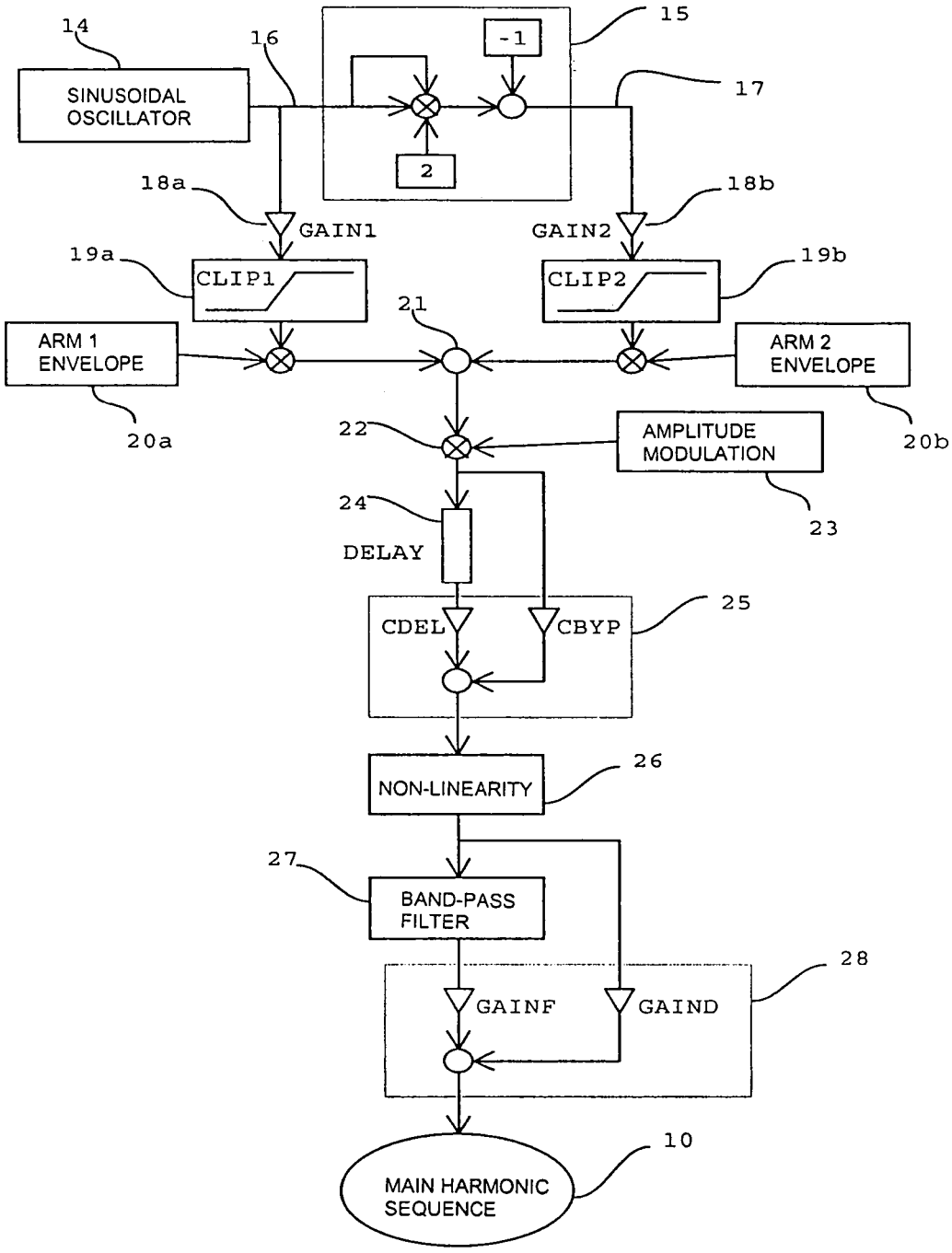
FIG. 3 shows a flow chart that explains one of the three blocks of FIG. 2, according to which a sequence that represents the harmonic part of the sounds of church organ flue pipes according to the invention is generated.

The block (9) generates a main harmonic sequence (10) composed of a set of harmonic lines, whose amplitude and frequency conveniently change over time. By using this sequence and taking advantage of part of its composition, the block (11) generates a pseudoaleatory signal that represents the chaotic component of the sound. The aforementioned sequences are the two input signals of the linear resonator (12) that models the frequency response of the resonant part of the multiple qualities of organ flue pipes, and whose output (13) is the sequence that represents the sound of the organ pipes. The block diagram of FIG. 3 is a detailed view of the functional blocks of the harmonic component generator (9). The oscillator (14) generates an approximately sinusoidal waveform (16). The fundamental frequency of the waveform changes over time within a range of values comprising the fundamental frequency of the generated musical note. The details of the embodiment of the oscillator and the criterion used to change frequency over time are illustrated below.

The waveform (17) is obtained from the sequence (16) through the non-linear block (15): if the sequence (16) were exactly a sinusoidal sequence $$x[n]=\sin[\omega_0 n],$$

the sequence (17) would be $$y[n]=2(\sin[\omega_0 n])^2-1=-\cos[2\omega_0 n]=\sin[2\omega_0 n-\pi/2],$$

that is to say a sinusoid with double frequency than the sequence (16).

Each of the two sequences (16) and (17) is amplified by the relevant multipliers (18*a*) and (18*b*), and limited by the functional blocks (19*a*) and (19*b*) to values within the ±CLIP1 and ±CLIP2 intervals. The outputs of the blocks (19*a*) and (19*b*) are multiplied by two sequences produced by the envelope generators (20*a*) and (20*b*), respectively, as illustrated below, and the resulting products are summed to the node (21). The sum is a sequence produced by a series of linear and non-linear instantaneous operations performed on the waveform (16). If the waveform were exactly the sequence x[n], a sequence would be obtained in the node (21) whose spectrum would be formed by harmonic components multiple of $\omega_0$ (including $\omega_0$).

As illustrated below, the sequence (23) is a low frequency waveform, whose purpose is the amplitude modulation of the harmonic sequence through the product (22).

The element (24) is a delay line whose impulse response is the sequence $\delta_{-1}[n-N]$. Together with the products and the sum of the block (25), this element forms a linear filter whose impulse response is $$CBYP+CDEL\cdot z^{-N}.$$

The block (26) is a non-linear instantaneous function described by the following formula:

$$f(x)=(x+x_0)-(x+x_0)^3+y_0$$

where $x_0$ and $y_0$ are independent parameters. The purpose of the block is to modify the mutual proportion between the amplitudes of the harmonic components of the sequence processed by the block.

The block (27) is a band-pass filter, whose peak frequency corresponds to the fundamental frequency of the input sequence. The parameter Q of the filter is tuned up to obtain the only fundamental frequency of the input harmonic sequence with excellent approximation. Moreover, being the phase response of the filter null in correspondence of the peak frequency, the phases of the fundamental frequency of the input and output signals of the filter are equal. This characteristic enables to sum the input and output sequences of the filter, with no elision effect in the fundamental frequency: the block (28) sums the sequences (weighing them with the parameters GAIND and GAINF), in order to alter the proportion in amplitude between the fundamental harmonic component and the group of all other harmonic components. The output of the block (28) is the main harmonic sequence (10).

The sinusoidal oscillator (14) consists in a special embodiment of the ordinary harmonic oscillator with two status variables, with necessary measures to improve the robustness to the variation of the operational frequency in real time.

Figure 4:
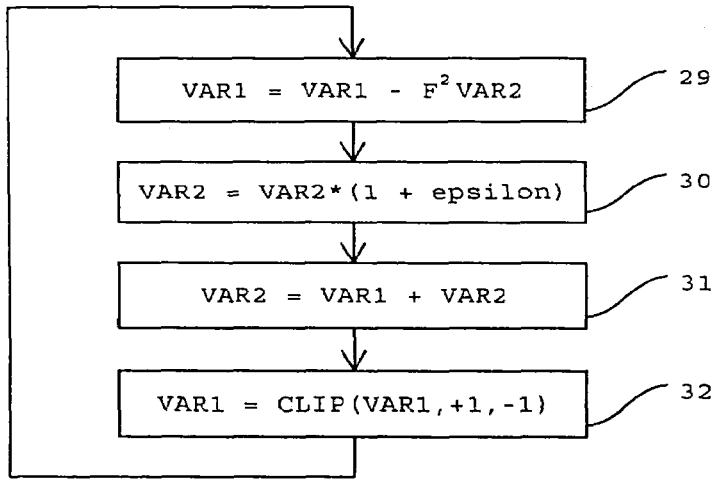
FIG. 4 shows a stable realisation of a digital harmonic oscillator with two status variables according to the invention.

FIG. 4 shows the cycle of operations performed at each sampling interval on the two conveniently initialised status variables VAR1 and VAR2. The parameter F determines the frequency of the sinusoid produced by the status variables oscillator that is composed of the steps (29) and (31) in the ordinary configuration. The disadvantage of the ordinary configuration is that it cannot suffer variations of the parameter F in real time without altering the amplitude of the sinusoids described by the same variables, in function of the current value of the status variables. Moreover, depending on the numerical precision of the oscillator's status variables, reductions of the oscillation amplitude can occur even in stationary conditions. It is sufficient to amplify the variable VAR2 by a factor $1+\epsilon$ (with $\epsilon$ positive, but close to zero) by means of the step (30) and limit the width of the variable VAR1 by means of the step (32) to values within the interval ±1. Using these measures, the variable VAR1 describes a unitary amplitude sinusoid with excellent approximation. This variable is the output (16) of the block (14) of FIG. 3. The parameter F depends on the frequency f according to the relation $$F(f)=2\sin(\pi f/f_{sr})$$

where $f_{sr}$ is the sampling frequency. The frequency f can vary in real time within an interval $[f_0-\Delta f, f_0+\Delta f]$ sufficient to have the frequency changes perceived, without a collateral amplitude alteration.

Figure 5:
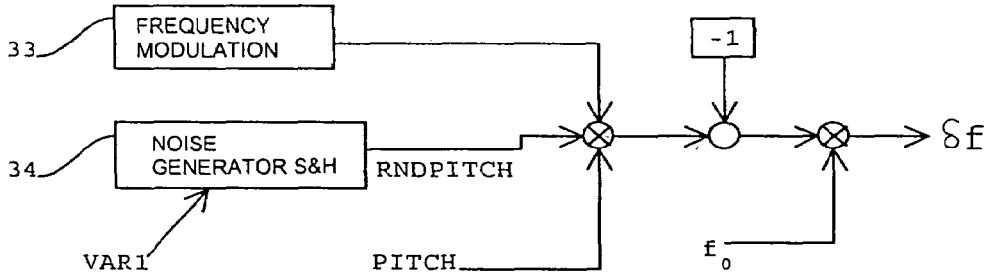
FIG. 5 shows a procedure used to generate the time variation of the operational frequency of the harmonic oscillator shown in FIG. 4 according to the invention.

Having defined the deviation from the central frequency $f_0$ as $\delta f$, this parameter changes in real time according to the scheme of FIG. 5. Likewise the signal (23), the signal (33) is a low frequency waveform whose purpose is the frequency modulation of the generated sinusoid; with the support of the variable VAR1, the block (34) generates an aleatory waveform of "sample and hold" type, according to the scheme of FIG. 6. Ultimately, $\delta f$ varies according to a constant PITCH parameter (which, assuming a value in an arbitrary interval $[1-\delta, 1+\delta]$, determines the fine tuning of the sinusoid) of an oscillating sequence (33) and the aleatory sequence (34). The block (34) is described in FIG. 6: every time the variable VAR1 passes from a negative value to a positive value, the variable RNDPTCH is updated to a new value NEWRND, which is an aleatory variable with a probability density function uniformly distributed in the interval $[1-\delta RNDP, 1+\delta RNDP]$, being $\delta RNDP$ an independent parameter.

Figure 7:
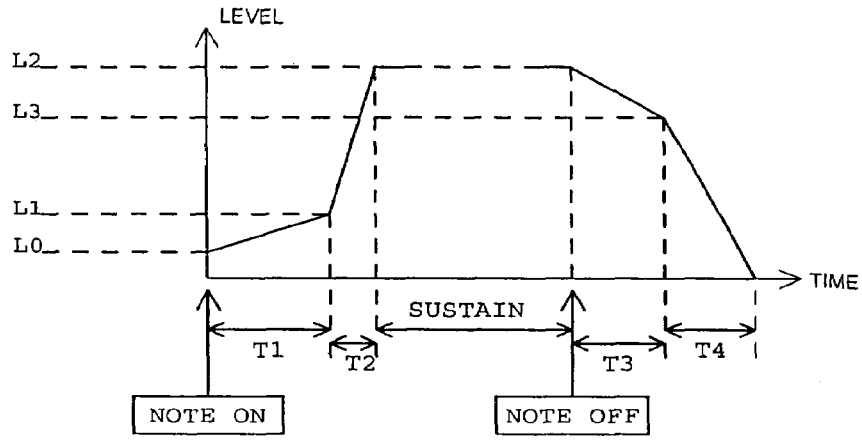
FIG. 7 shows an example of time envelope used in the generation of the sequence that represents the harmonic part of the sounds of flue pipes according to the invention.

The two generators (20A), (20B) produce two 5-segment envelope signals, whose progression is generically illustrated in FIG. 7. T1 . . . T4 are the time intervals in which the signal passes from level L0 to L1, from L1 to L2, from L2 to L3 and from L3 to zero, respectively. The generators start producing the respective envelope signals upon a "note on" event. Level L2 is maintained over time for an indefinite interval SUSTAIN, whose end coincides with the corresponding "note off" event. Each of the two generators uses its own set of these 8 parameters.

Figure 8:
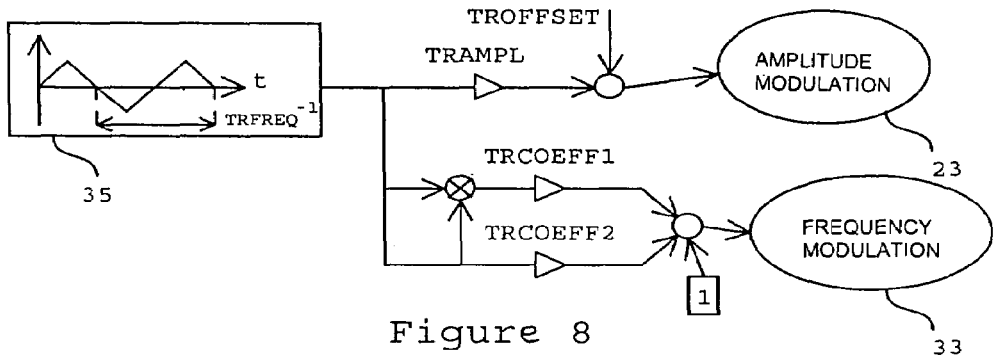
FIG. 8 shows a flow chart of a low frequency oscillator used in the generation of the sequence that represents the harmonic part of the sounds of flue pipes according to the invention.
Figure 9:
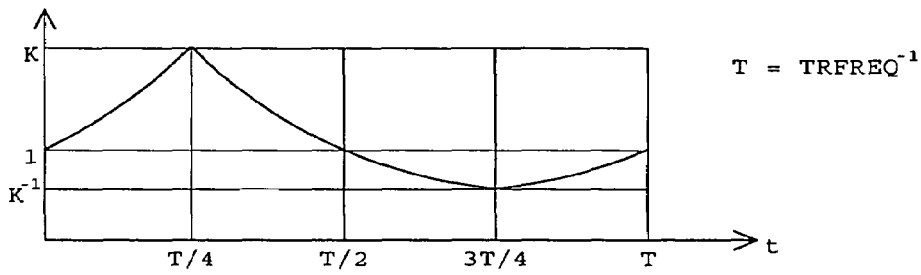
FIG. 9 shows a time progression composed of non-rectilinear sections, according to which the frequency of an oscillator can be changed without perceiving an alteration of timbre pitch according to the invention.

The signals (23) and (33) are produced by a "Low Frequency Oscillator" shown in FIG. 8. The generation method of the triangular waveform with unitary amplitude and frequency TRFREQ illustrated in the block (35) is implicit. The parameters TRFREQ, TRAMPL, TROFFSET, TRCOEFF1 and TRCOEFF2 determine the conformation of the two signals (23) and (33), whose common fundamental frequency is TRFREQ. In particular, the signal (32) is a triangular wave of average value TROFFSET and semi-amplitude TRAMPL, while the signal (33) is formed by sections of parabolas, as shown in FIG. 9. The relation between the values TRCOEFF1, TRCOEFF2 and the independent parameter K is biunique. The special progression of the signal (33) is necessary to obtain a triangular frequency modulation as exactly as possible (ref. FIG. 5) around the nominal frequency $f_0$, with equal progressions of the positive and negative semi-periods, if they are expressed in semitone cents.

Figure 10:
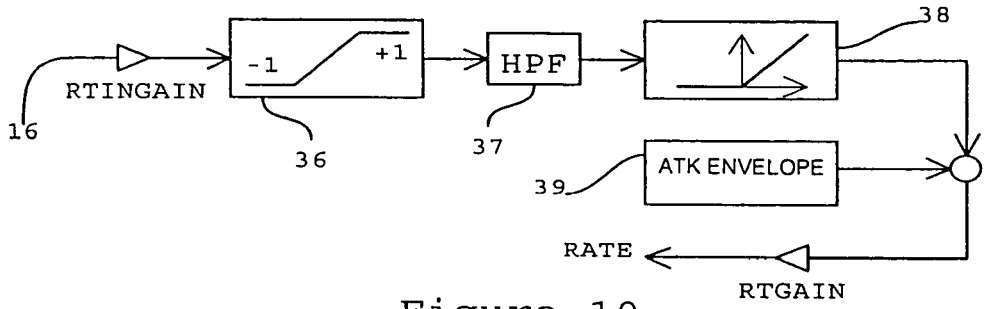
FIG. 10 shows an algorithm for the generation of a pseudoimpulsive periodic sequence according to the invention.
Figure 11:
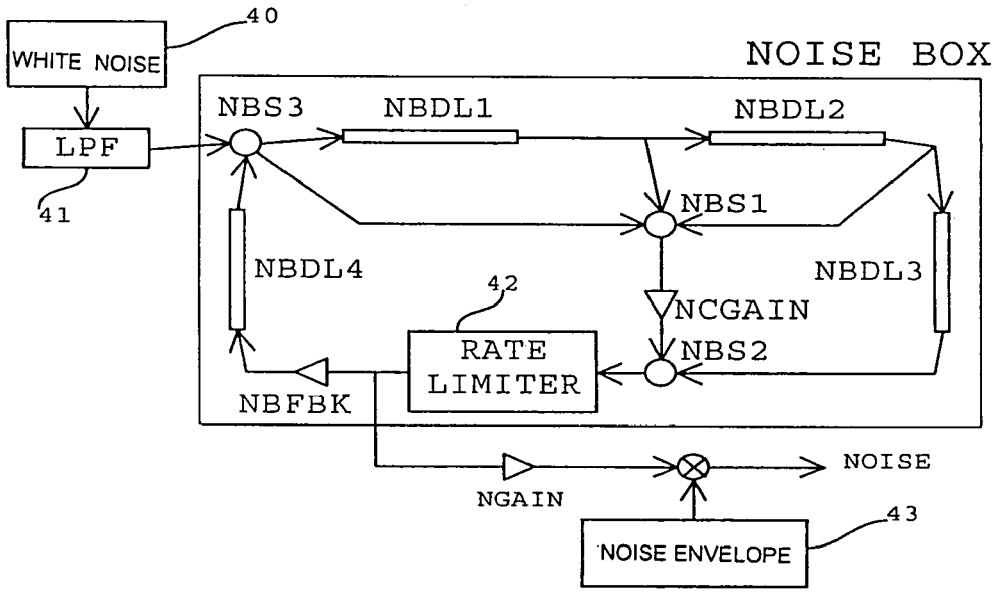
FIG. 11 shows a set of interconnected functional blocks that explains one of the three blocks of FIG. 2, according to which a sequence that represents the aleatory part of the sounds of church organ flue pipes according to the invention is generated.
Figure 13:
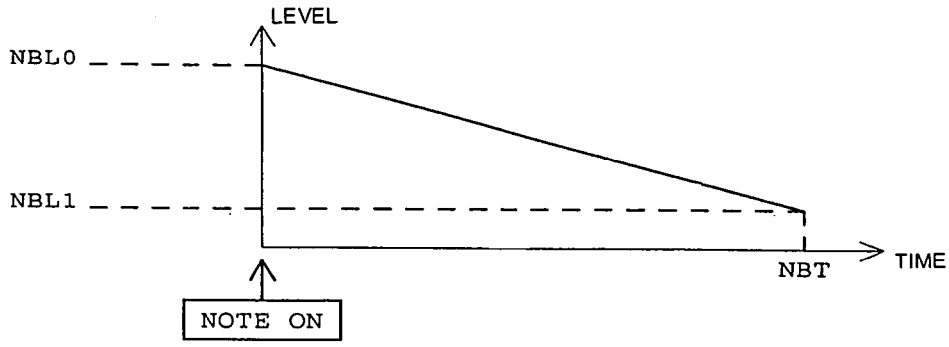
FIGS. 13 and 16 show an example of wave envelope used during the attack transient phase of the generation of sounds of flue pipes according to the invention.
Figure 14:
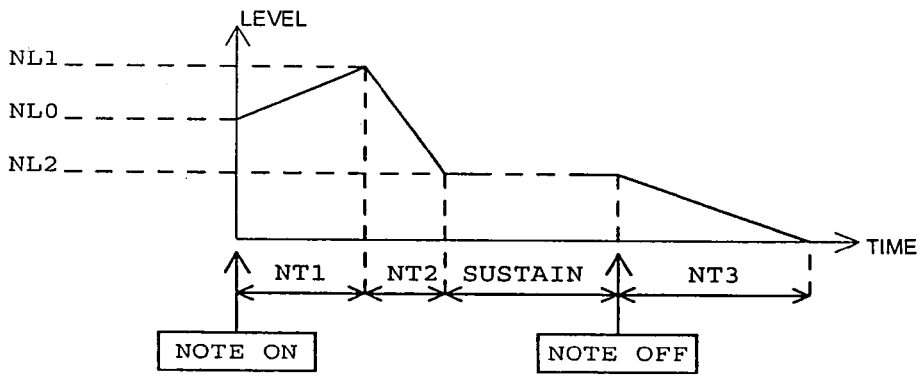
FIG. 14 shows a wave envelope used to generate the aleatory component of the sounds of flue pipes according to the invention.

The architecture of the generator (11) of FIG. 2 is illustrated with details in FIGS. 10, 11 and 12. With reference to FIGS. 3 and 10, the signal (16) produced by the sinusoidal oscillator (14) is amplified by a factor RTINGAIN, limited in amplitude by the block (36) to values within the interval ±1, and then processed by the high-pass filter (37). Finally the non-linear block (38) cuts the signal's negative values. At the output of the block (38) the signal (illustrated in FIG. 13) produced by the envelope generator (39) is summed and the result is multiplied by the parameter RTGAIN. The result RATE is a sequence of values used in the non-linear block (42) defined as "RATE LIMITER", which is part of the structure described in FIG. 11. With reference to FIG. 11, the functional block (40) generates a white aleatory sequence, with a uniformly distributed probability density function processed by the low-pass filter (41). The obtained sequence is the input signal of the structure formed by the delay lines NBDL1, NBDL2, NBDL3, NBDL4, the sums NBS1, NBS2, NBS3, the multipliers NCGAIN, NBFBK and the non-linear block (42). The set formed by these elements, including the topology of interconnections, is defined as "NOISE BOX". The signal generated by the block (42), which is the output of the aforementioned set, is amplified by a factor NGAIN and multiplied by the signal produced by the envelope generator (43), whose time progression is illustrated in FIG. 14. The signal NOISE is the output of the generator (11) of FIG. 2.

FIG. 12 describes the non-linear block "RATE LIMITER" (42) formed by the sums RLS1, RLS2, the limiter (44) and the unit delay element (45). The value memorised in the delay (45) is subtracted by means of the adder RLS1 from the input signal "IN"; the result is then limited to values within the interval ±RATE (being RATE the sequence generated by the network illustrated in FIG. 10), and finally summed again to the current delay value (45) at the node RLS2. The result "OUT" is memorised in the delay element (45) for a successive cycle. FIG. 13 shows the time progression of the envelope generated by the block (39): upon a "note on" event, starting from the level NBL0, the level NBL1 is reached in a time NBT, indefinitely sustained over time, also after the corresponding "note off" event. FIG. 14 shows the time progression of the sequence generated by the block (43): upon a "note on" event, the signal starts from the value NL0, reaches the value NL1 over a time NT1 and the level NL2 over a time NT2 sustained until the successive "note off" event. Upon this event the signal reaches the value zero in a time NT3.

Figure 15:
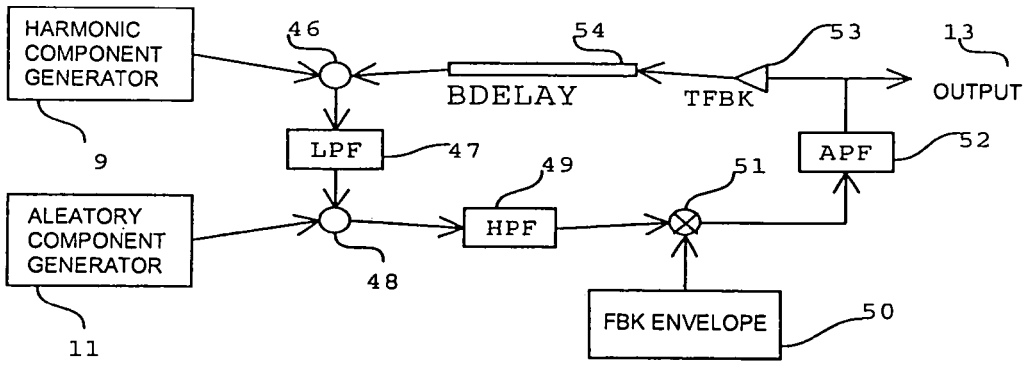
FIG. 15 shows an architecture that explains one of the three blocks of FIG. 2, representing a mathematical model of the resonator of the church organ flue pipes according to the invention.
Figure 16:
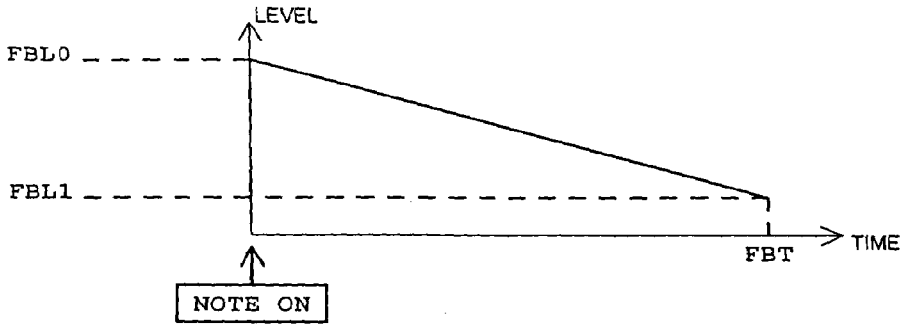

With reference to FIG. 11, the non-linear block "RATE LIMITER" (42) can be replaced with a linear filter, whose gain has a progression described by the same sequence RATE generated by the architecture of FIG. 10, so that the structure "NOISE BOX" of FIG. 11 is a linear time-variant filter. With reference to FIG. 2, the outputs of the generators (9) and (11) are the inputs of the resonator (12) illustrated with details in FIG. 15. The functional blocks of the network (12) form a cycle of operations, along which a sequence of samples propagates for a potentially infinite time. The two contributions of the two generators (9) and (11) are added to this sequence, instant by instant in the sum nodes (46) and (48) nodes, respectively, to sustain the energy of the computed sequence. The structure of FIG. 15 is the translation into a mathematical model of the resonant part of the organ flue pipe, defined as "pipework". In particular, the low-pass filter (47) emulates the dissipation of acoustic energy, with variable intensities in function of the frequency; the high-pass filter (49) attenuates all the frequency components lower than the fundamental frequency; by means of the product (51), the envelope generator (50) produces a signal that represents the time progression of the loop gain of the resonant system; the filter (52) alters the sequence phase, leaving its module unchanged; the factor TFBK (53) depends on the type of acoustic termination at the top of pipework; finally, the delay line BDELAY (54) considers the time needed by an acoustic pressure wave to cover the pipework from the base to the top and vice versa. The time progression of the signal produced by the envelope generator (50) is traced in FIG. 16: likewise the envelope of FIG. 13, upon a "note on" event, the signal passes from a value FBL0 to a value FBL1 in a time FBT, and then remains constant. The output sequence (13) is the signal emitted by the mathematical model of FIG. 2 as a whole, that is to say the time representation of the sound emission of the organ flue pipes.

The description continues with the original innovative characteristics of the audio digital synthesis technique of the sound of flue pipes.

Figure 17:
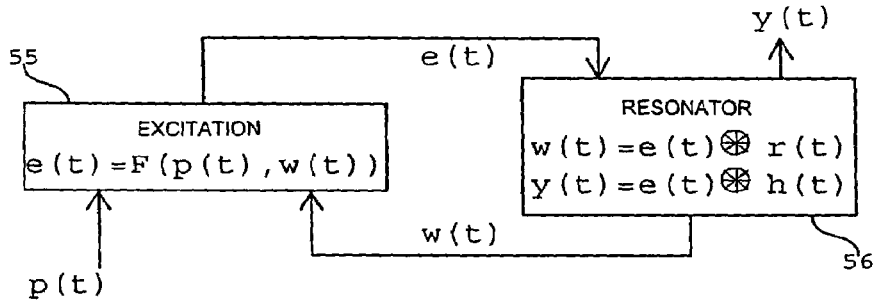
Figure 17 PRIOR ART
FIG. 17 shows the mutual interaction between two functional blocks necessary for the realisation of a generic harmonic oscillator according to the invention.

The literature on the generation of sounds of instruments with continuous sound emission, among which aerophone instruments, by means of the physical modeling technique, proposes solutions based on a mutual interaction between a non-linear active part, normally defined as excitation (55), and a linear passive part, defined as resonator (56), according to the scheme of FIG. 17. In the case of aerophone instruments, the energy contributed to the system is in the form or sound pressure and the signal produced is the progression of the sound pressure wave irradiated by one or more suitable points of the resonator. The waveform p(t) is the progression of the air pressure that the performer (or the bellows, in the case of a church organ) exercises on the instrument mouthpiece. According to this progression and to the progression of the pressure w(t) in a suitable point inside the resonator, an oscillating acoustic pressure e(t) injected in the resonator is generated. Once the sustain phase has been reached, the pressure e(t) has the same fundamental frequency as the pressure w(t). Being linear (except for very special operation modes), the resonator can be described with an impulse response r(t), which generates the return signal w(t) and an impulse response h(t), which generates the output signal y(t). The latter is the time progression of the sound emission of the instrument. Being it a numerical simulation performed in the time domain instead of the frequency domain, the fundamental frequency of the oscillation on which the system stabilises, once the sustain phase has been reached, is extremely difficult to predict mathematically. This depends on the fact that the frequency depends on the time progression of the forcing signal e(t), and not only on the frequency values in which the amplitude spectrum of the impulse response of the resonator has the relative maximum values. In fact, any type of harmonic oscillator (electronic, mechanical, etc.) has this characteristic. With regard to wind instruments (including organ pipes), it is sufficient, for example, to increase the sound pressure to obtain an increase of the fundamental frequency of the acoustic wave, in addition to an intensity increase, although the characteristics of the resonant part remain unchanged.

Another inevitable characteristic of the oscillating systems illustrated in FIG. 17 is the unpredictability of the phase of the generated signal, once the sustain phase has been reached. Since the waveform p(t) used to stimulate the system is partially chaotic, and in any case it does not contain any information about the phase of the stationary wave sustained by the resonator, the attack transient of the signal y(t) is always and unpredictably different. Therefore, although the waveform has always the same periodic time progression in sustain conditions, it is impossible to determine the evolutions that bring the system towards this progression. In quantitative terms, it is impossible to determine the phase of the fundamental frequency of any signal processed inside the stable oscillating system of FIG. 17, taking the instant when the stimulus p(t) starts as time origin. Together with the difficulty encountered in determining the fundamental frequency a priori, this is unacceptable in the field of high-polyphony electronic musical instruments, such as church organs.

The synthesis system used in the present invention derives directly from the synthesis in the time domain described in general and is characterised by the total autonomy of the excitation signal from the signal produced by the resonator. In fact, the main harmonic sequence (10) extemporarily generated by the block (9) of FIG. 2 is the imitation, as faithful as possible, of the signal e(t) of the system of FIG. 17 (assuming that the latter is a good mathematical model of the flue pipe of a church organ), with the substantial difference that the fundamental frequency and the phase of this sequence, and consequently of the sequence produced by the system (13) as a whole, are perfectly determined a priori.

The preparation of the numerical parameters of any oscillating system, as generically illustrated in FIG. 17, requires special sensitivity and skill, apart from the perfect knowledge of its mathematical model. This means that the good operation of the system may be impaired, and the system may become unstable or even inharmonious, if only one of the parameters has a value not included in a proper range. Moreover, different operational modes of the oscillator can be obtained only by acting simultaneously and with special attention on a plurality of parameters, with the risk of making the time evolution of one or more signals in transit along the functional blocks of the system uncontrollable. This makes the search for multiple sounds produced by this type of synthesis slow and difficult. On the contrary, a system with no feedback between resonator and excitation, such as the system shown in FIG. 2, enables to modify the numerical parameters of the three functional blocks (9), (11), (12) in a completely independent way, without impairing the good operation of the system as a whole. This allows obtaining a larger variety of sounds than the one obtained by means of a feedback loop system with equal complexity.

The system of FIG. 3 shows a sequence of operations performed on the signal produced by the sinusoidal oscillator (14). The type and order of the operations are only one of the possible realizations used to generate a waveform sufficiently rich in harmonic components and provided with a suitable time evolution. In any case, some of the functional blocks of the system, such as the delay (24) and the non-linear function (26), derive from mathematical models of wind instruments known in the literature, without the need of using them. The originality of the system mainly consists in the adaptation of an ordinary oscillator with status variable to non stationary operational conditions, by developing the functional blocks (30) and (32) of FIG. 4, in order to make the oscillator robust to the variations of the parameter $F^2$ of the block (29).

Figure 6:
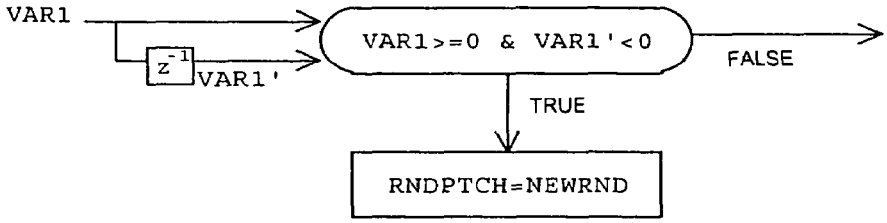
FIG. 6 shows a flow chart used to generate the aleatory component of the time progression of the operational frequency of the harmonic oscillator shown in FIG. 4 according to the invention.

With reference to FIGS. 5 and 6, the originality derives from the development of the generator (34) to obtain pleasing random frequency variations in real time. Assuming the factor (33) as constant, that is to say assuming the absence of the low frequency oscillation of the sequence δf, the latter assumes a new random value at every period of the sinusoidal sequence VAR1. The result is a statistic uniformly distributed variation of the wave period, in terms of probability density function.

The variation is perceived as a pleasant irregularity in the sound emission. Otherwise, if δf assumes a new random value at every sampling instant, the length of every wave period will be described by a variable formed by the sum of N aleatory contributions, each of them provided with uniformly distributed probability density (N is the number of samples per period). In view of the Central Limit Theorem, the higher is N, the more the probability density function of this variable approaches a Gaussian function. The frequency variation would be very irregular, since high frequency deviations would be obtained much more rarely than small deviations from the nominal frequency. This would be very unpleasant, since wave periods with very different length from the nominal length could be generated and perceived as sudden malfunctions of the generation model.

Figure 18:
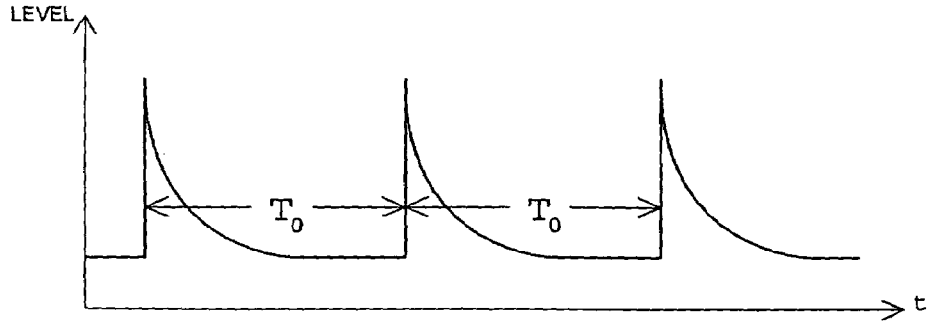
FIG. 18 shows an example of a pseudoimpulsive periodic waveform generated by the algorithm of FIG. 10, used to generate the aleatory component of the sounds of flue pipes according to the invention.

The generator of the aleatory component (11) of FIG. 2 is completely original, and the embodiment of FIGS. 10, 11 and 12 derives from the analysis of samples of sounds emitted by a large variety of organ flue pipes, and from some hypotheses on their operation physics. In particular, by analysing the spectrogram of the individual wave periods of a sample and using a much finer time resolution than a wave period, it can be noted that a large percentage of sound energy concentrates in a time interval much shorter than the period, always situated in the same position along the wave period. Such sound energy covers a frequency interval considerably higher than the interval covered as an average by a plurality of periods. Therefore, the characteristics of the spectrogram of the stationary part of the sound of flue pipes are similar to the spectrogram of a train of equidistant impulses, with the energy of the individual period concentrated in each impulse. These considerations justify the architecture illustrated in FIG. 10: the sequence RATE is obtained through a series of elementary deterministic operations performed on the sinusoid (16). Once the sustain phase has been reached, the sequence RATE assumes a qualitatively impulsive progression, of which FIG. 18 shows one example, where $T_0$ is the period of the sinusoid (16). Regardless of the method used to obtain a pseudoimpulsive sequence, the sequence is conceptually one of the inventive foundations of the generator (11). The structure illustrated in FIG. 11 is formed by the four delay lines NBDL1, NBDL2, NBDL3, and NBDL4. Together with the sums NBS1, NBS2, and the product NCGAIN, the first three delay lines form a FIR filter. The output of this filter (that is to say the sum NBS2) is processed by the non-linear element (42) and then, after being multiplied by NBFBK and after passing through the fourth delay line and the sum NBS3, injected again in the aforementioned filter. If it weren't for the element (42), the structure "NOISE BOX" would be a linear filter, whose spectrum would have a voluntarily inharmonious progression, with a plurality of resonance peaks distributed in a non-deterministic way, depending on the length of the delay lines and the two independent parameters NCGAIN and NBFBK. These four quantities are dimensioned in order to imitate the frequency response of a resonator with irregular geometry, such as the portion of space of the organ pipe immediately inside the mouth. Because of the periodic oscillation of the sequence RATE, the element (42) causes a continuous periodic variation over time of the "gain" (not strictly definable as such, since the "RATE LIMITER" is a non-linear block) of the entire "NOISE BOX". In particular, with reference to FIG. 18, when the sequence RATE assumes the minimum value, the non-linear distortions caused by the block (42) imply energy losses that heavily reduce the resonance effects of the "NOISE BOX". Vice versa, during the (much shorter) instants in which the sequence RATE assumes relatively high values, the resonant effect of the "NOISE BOX" emerges and the intensity of the aleatory component increases. It can be noted that during the attack transient, because of the envelope generator (39), whose progression is shown in FIG. 13, the sequence RATE assumes higher values than during the sustain phase; this increases the resonance of the "NOISE BOX" during the first instants of synthesis, in order to simulate the acoustic phenomena defined as chiff, cough, etc. produced by the flue pipes if the valve that regulates the passage of air from the bellows to the foot is opened rapidly.

The non linear block (42) is formed by the two adders RLS1, RLS2, the limiter (44) and the unit delay element (45). At every sampling instant, the difference between the previous output value and the current input value is first limited in width to values within the interval RATE and summed again to the previous output value, thus obtaining the current output value. The output sequence "follows" the input sequence, maintaining an inclination limited according to the value RATE. For mere illustrative purposes, FIG. 19 shows a chart of an input sequence (continuous line) and an output sequence (dotted line). In the instant to the inclination of the sequence IN exceeds the value RATE/sample, therefore the sequence OUT separates until it re-joins at point $t_1$, after which the sequence IN remains constant. In the instant $t_2$ the excessive inclination of the sequence IN causes the immediate separation of the sequence OUT up to the re-conjunction point $t_4$. With respect to a linear filter, the advantage of the "RATE LIMITER" is the elimination of possible discontinuities of the aleatory sequence, while still maintaining a sufficient bandwidth, being such discontinuities extremely unpleasant for the human hearing. This aspect represents the originality of the "RATE LIMITER".

The non linear block (42) can be replaced with any functional block whose effect on the structure "NOISE BOX" of FIG. 11 is the quantitative resonance variation generated by the structure, according to a periodic progression.

As regards the linear resonator (12), the physical considerations that involve the choice of the functional blocks of FIG. 15 are described herein. The resonant part of an organ pipe, defined as pipework, can be mathematically described, in the most elementary way, with a "comb" filter $1/(1-FBK\cdot z^{-N})$, in which the feedback coefficient FBK is related to the loop gain of the filter and the parameter N is inversely proportional to the first resonance frequency of the same. The more complex resonator of FIG. 15 derives from this base, which is very used in the field of audio digital processing. Among the elements of the resonator, the function of the delay line (54) appears evident. The response in module of the low-pass filter (47) is designed so as to consider the different energy losses suffered by the various harmonic components during their transit along the pipework, while the high-pass filter (49), whose cut-off frequency is lower than the fundamental frequency of the resonator, completely eliminates the continuous component of the stationary wave, to take into account the fact that the average acoustic pressure inside a pipework is approximately equal to the external pressure. Because of the envelope generator (50), during the first operation phase of the resonator, the loop gain of the system is moderately overabundant with respect to the value once the sustain phase has been reached, in order to obtain a faster initial energy accumulation in the resonator, that is to say a faster attack transient of the generated sound. The sign of the factor TFBK (53) is especially important: a positive sign for a pipework open at the mouth and on top, and a negative sign for a pipework open at the mouth and closed on top. This derives from the physics of the reflection of an acoustic pressure wave in correspondence of the pipework terminations.

This physical law also justifies the use of the all-pass filter (52), the most important element of the resonator from the conceptual point of view. If, on one side, the mono-dimensional model of the pipework is sufficiently accurate to justify the use of an individual delay line to simulate the longitudinal propagation of an acoustic wave in the pipework, the approximation becomes unacceptable in the wave reflection in correspondence of a structural discontinuity characterized by non-negligible transversal dimensions, such as the top of the pipework. The all-pass filter (52) modifies the total phase delay of the closed cycle formed by the elements (46) . . . (54) in a selective way with respect to the frequency, in order to make the resonance of the linear resonator (12) realistically inharmonious. The same filter is optionally used to modify the value of the first resonance frequency of the pipework in real time through controlled variations of its coefficients upon a "note off" event, to simulate the phenomenon of the moderate reduction of the fundamental frequency of the sound of small flue pipes when the air inlet valve closes.

The invention claimed is:

1. A method suitable for church organ flue pipes' sound synthesis comprising:

generating a first sinusoidal sequence (16), generating a second sinusoidal sequence (17) whose frequency is a multiple of said first sinusoidal sequence's frequency, generating a harmonic sequence (10) by means of processing said sinusoidal sequences, generating a periodic sequence (RATE) whose frequency is proportional to said harmonic sequence's frequency, generating a random sequence and processing said random sequence by means of a rate limiter (42) to obtain a limited rate sequence, and generating a sequence (NOISE) by means of processing said limited rate sequence, and processing said harmonic sequence (10) and said sequence (NOISE) by means of a closed loop of linear functional blocks to obtain an output sequence (13) which represents the sound of church organ flue pipes.

2. A method as described in claim 1, wherein said generation of a harmonic sequence step includes processing said sinusoidal sequences (16 and 17) by means of non-linear transformations and envelope generators (20*a* and 20*b*).

3. A method as described in claim 1, wherein said generation of a harmonic sequence step includes the generation of an aleatory signal (RNDPITCH) which is used to modify the wavelength of said harmonic sequence with an oftenness which is proportional to said sinusoidal sequences' frequency.

4. A method as described in claim 1, wherein said generation of said sequence (NOISE) step includes generating the random sequence, processing said random sequence by means of the loop containing a rate limiter.

5. A method as described in claim 1, wherein said generation of said sequence (NOISE) step includes generating the random sequence and processing said random sequence by means of the loop containing delay lines and a rate limiter, said rate limiter being controlled by said periodic sequence (RATE).

6. A method as described in claim 1, wherein said harmonic sequence and (NOISE) sequence processing step includes a linear resonator and supplies said harmonic sequence and (NOISE) sequence into the closed loop composed of a delay line and linear filters, and extracting from said closed loop the sequence which represents the church organ flue pipes' synthesized sound.

7. An electronic device for church organ flue pipes' sound synthesis comprising:

a harmonic component generator (9) to synthesize a main harmonic sequence (10), a signal generator to synthesize a periodic sequence (RATE), a noise generator (11) to synthesize a random sequence, a rate limiter (42) to process said random sequence to obtain a limited rate sequence which is processed to generate a sequence (NOISE), and a linear resonator (12) generating a sequence (13) representing the sound of church organ flue pipes synthesized by said electronic device.

8. An electronic device as described in claim 7, said harmonic component generator (9) including two sinusoidal generators, two non-linear functional blocks whose inputs are connected to said sinusoidal generators' outputs, and two independent envelope generators, which are connected to said non-linear functional blocks' outputs.

9. An electronic device as described in claim 7, said harmonic component generator (9) including:

a sinusoidal generator, and a generator (34) which produces an aleatory sequence (RNDPITCH) whose samples change their random value with an oftenness which is proportional to said sinusoidal generator frequency, wherein said sinusoidal generator's frequency is modulated by said aleatory sequence (RNDPITCH).

10. An electronic device as described in claim 7, said noise generator (11) including:

a random sequence generator, and a closed loop containing a rate limiter, wherein said closed loop is connected to said random sequence generator, and said rate limiter is connected to said signal generator to synthesize a periodic sequence (RATE).

11. An electronic device as described in claim 7, said linear resonator including:

a delay line and linear filters forming a closed loop, an input node connected to said harmonic component generator (9) and an input node connected to said noise generator (11), and an output node where said sequence (13) representing the sound of church organ flue pipes is generated.

* * * * *